United States Patent [19]

Stadler

[11] Patent Number: 4,608,947

[45] Date of Patent: Sep. 2, 1986

[54] ARRANGEMENT FOR COOLING PISTONS AND CYLINDER SLEEVES

[75] Inventor: Hans Stadler, Berg.-Gladbach, Fed. Rep. of Germany

[73] Assignee: Klöckner-Humboldt-Deutz Aktiengesellschaft, Cologne, Fed. Rep. of Germany

[21] Appl. No.: 752,373

[22] Filed: Jul. 5, 1985

[51] Int. Cl.[4] ..... F10P 3/10

[52] U.S. Cl. ..... 123/41.39; 92/186

[58] Field of Search ..... 123/41.39, 41.35, 193 P; 92/160, 186

[56] References Cited

U.S. PATENT DOCUMENTS

| | | | |
|---|---|---|---|
| 2,911,963 | 11/1959 | Goldsmith | 123/41.39 |
| 2,967,516 | 1/1961 | Stümpeig | 123/41.39 |
| 4,011,797 | 3/1977 | Cornet | 123/193 P |
| 4,180,027 | 12/1979 | Taylor | 123/41.35 |
| 4,280,455 | 7/1981 | Yamaguchi et al. | 123/41.39 |
| 4,359,973 | 11/1982 | Shimada | 123/41.39 |

FOREIGN PATENT DOCUMENTS

| | | | |
|---|---|---|---|
| 2541966 | 3/1977 | Fed. Rep. of Germany | 123/41.35 |

*Primary Examiner*—William A. Cuchlinski, Jr.
*Attorney, Agent, or Firm*—Becker & Becker, Inc.

[57] ABSTRACT

An arrangement for cooling the pistons and cylinder sleeves of an internal combustion engine. An annular cooling chamber is provided in the piston, and is open along the circumferential surface of the piston in the direction toward the cylinder sleeve. This cooling chamber is divided into subchambers over a portion of its axial height. Cooling medium is supplied into a given subchamber, while cooling medium is withdrawn in the adjacent subchamber. The portion of the cooling chamber which is free of partitions may be embodied as an annular groove which is disposed radially inwardly of the piston rings. The particular cooling effect is essentially brought about by the back and forth movement of the cooling medium not only axially but also in the circumferential direction in the annular groove. In so doing, the cooling medium wets the cylinder sleeve during the up and down movement of the piston. With a great enough quantity of cooling medium, external cooling of the cylinder sleeve can be either entirely or partially dispensed with. An axially extending flange-like member can be provided as an economical replacement for an oil wiping ring.

19 Claims, 9 Drawing Figures

FIG.6
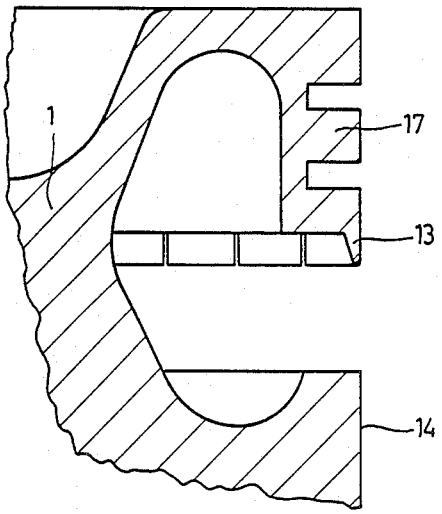
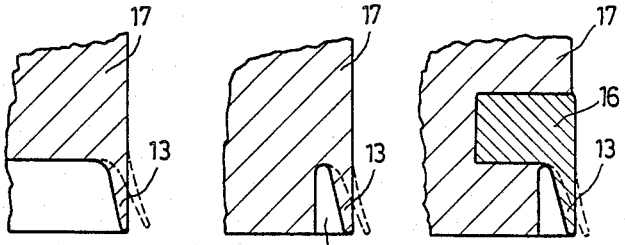
FIG.7a FIG. 7b FIG. 7c

ARRANGEMENT FOR COOLING PISTONS AND CYLINDER SLEEVES

BACKGROUND OF THE INVENTION

The present invention relates to an arrangement for cooling the pistons and cylinder sleeves of pistons/cylinder units of an internal combustion engine. Each piston/cylinder unit has at least one cooling chamber, which is delimited by the piston and the cylinder sleeve of that unit, and also has suitable sealing means, for example piston rings, provided on that end of the piston closest to the combustion chamber. The cooling chamber extends in the circumferential direction of the piston, is provided with means to supply cooling medium thereto and with means to withdraw cooling medium therefrom, and is provided with at least two approximately axially extending guide elements.

With regard to internal combustion engines, it is necessary to keep the heat which is produced during combustion away from the components of the engine, at least to such an extent that these components are not damaged. Thus, it is already customary to cool the thermally highly stressed piston with motor oil, whereas the outer periphery of the cylinder sleeve or barrel is either air cooled or water cooled. The present invention is concerned with combining the cooling of the piston and the cylinder sleeve, so that the overall cooling of the internal combustion engine, as well as its construction, can be improved and simplified German Offenlegungsschrift No. 25 41 966 discloses a cooling arrangement of this general type. In this known arrangement, the cylinder sleeve and the piston are cooled at the same time by a single cooling medium, with the cooling medium flowing into a cooling chamber disposed between the piston and the cylinder sleeve; the cooling medium cools the cylinder sleeve from within, and is withdrawn through a second opening. In a further embodiment of this known arrangement, the piston is provided on its surface with an annular space. The means for supplying and withdrawing cooling medium are radial bores which are disposed in the cylinder sleeve. In no position of the piston are these radial bores closed off by the piston. The cooling medium flows through the bore in the wall of the cylinder sleeve into the cooling chamber defined by the piston and the wall of the cylinder sleeve. As the piston moves up and down, the cooling medium cools the piston itself, and that portion of the wall of the cylinder sleeve over which the piston passes. In so doing, the cooling medium can furthermore cool the top of the piston via a separate central chamber within the piston. In order to increase the known Shaker effect, axial and also radial guide plates are provided in the cooling chamber for providing particularly good turbulence to the cooling medium. The cooling medium leaves the cooling chamber by means of a second exit bore located in the wall of the cylinder sleeve opposite the inlet bore. In order to make it possible to utilize a cooling medium other than the motor oil of the internal combustion engine, the aforementioned German Offenlegungsschrift further proposes sealing off the piston with piston rings not only at that end facing the combustion engine, but also at that end facing the crank case.

The aforementioned German Offenlegungsschrift No. 25 41 966 furthermore discloses connecting the cooling medium flow for the arrangement for cooling the cylinder sleeve and piston to an overall cooling medium circulation. While the internal combustion engine is being warmed up, the cooling medium flow can be heated, as a result of which the warm cooling medium flow heats the cylinder unit for the purpose of reducing wear.

However, this heretofore known cooling arrangement has the drawback that considerable partial flows of the cooling medium pass along the periphery of the piston directly from the cooling medium inlet to the cooling medium outlet. Furthermore, a second cooling medium flow is guided via a further separate cooling chamber to the top of the piston, where it cools the combustion chamber recess. The heat-absorption capacity of the cooling medium is therefore poorly utilized, because the heat-absorption capacity of one of the partial cooling medium flows is hardly made use of, whereas the heat-absorption capacity of the second partial cooling medium flow is heavily stressed. Furthermore, the cooling medium does not reach, in particular, the upper annular zones of the piston which are provided with the piston rings and are highly thermally stressed, so that these regions are insufficiently cooled.

It is an object of the present invention to provided a cooling arrangement for simultaneously cooling the piston and the cylinder sleeve, with the heat-absorption capacity of the available cooling medium being better utilized, so that the overall cooling of the internal combustion engine is optimized.

BRIEF DESCRIPTION OF THE DRAWINGS

This object, and other objects and advantages of the present invention, will appear more clearly from the following specification in connection with the schematic drawings, in which:

FIG. 6 is a partial axial section through a cooling chamber having a flange-like element as a sealing means relative to the combustion chamber;

Figure 1:
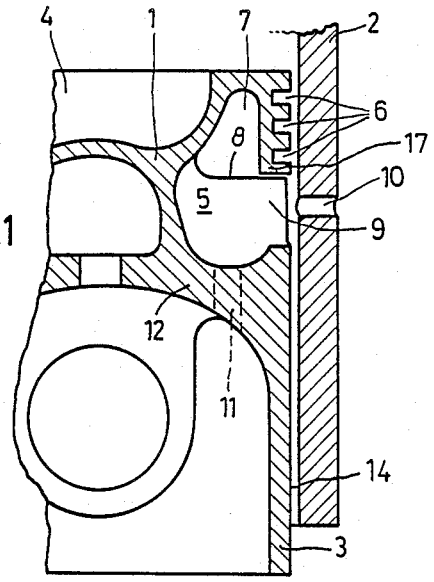
FIG. 1 is an axial section through one inventive embodiment of a piston to which cooling medium is supplied from the side.
Figure 2:
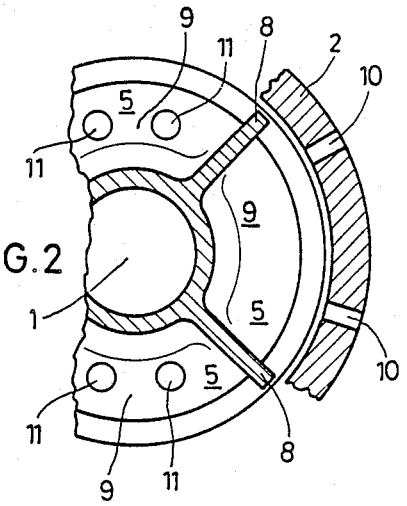
FIG. 2 is a cross section through the piston of FIG. 1.

FIG. *7a* is a cross section through an inventive flange-like element which projects separately from an annular wall of the piston;

FIG. *7b* is a cross section through an inventive flange-like element which is machined from the annular wall of the piston; and FIG. *7c* is a cross section through an inventive flange-like element which is in the form of a separate component which is inserted into the annular wall of the piston.

SUMMARY OF THE INVENTION

The arrangement of the present invention is characterized primarily in that the guide elements of the cooling chamber are in the form of partitions, with the height of the partitions, as measured in the axial direction of the cylinder, being less than the similarly measured height of the cooling chamber, so that the latter is divided into two axial portions, namely a first axial portion in which the partitions extend, and a second axial portion which is free of partitions; the partitions divide the first axial portion of the cooling chamber, in the circumferential direction of the piston, into at least two subchambers which are separated from one another, yet communicate with one another via the second axial portion of the cooling chamber; a given subchamber is provided with the cooling medium supply means, and the adjacent subchamber is provided with the cooling medium withdrawal means.

Thus, pursuant to the present invention the axial guide elements in the annular cooling chamber of the piston are embodied as partitions which extend nearly or completely to the circumference of the piston. In this way, at least two separate cooling spaces or subchambers are produced. The inventive proposal is that the partitions not extend over the entire axial height of the cooling chamber, but rather are disposed in only one axial portion of the cooling chamber. The separate subchambers thus communicate with one another via the second axial portion of the cooling chamber, which is free of partitions. Not only the cooling medium supply means but also the cooling medium withdrawal means are disposed in that axial portion of the cooling chamber which is provided with partitions, with the cooling medium supply means being disposed in one subchamber, and the cooling medium withdrawal means being disposed in the adjacent subchamber.

The particular advantage of the inventive embodiment of the cooling chamber is that the cooling medium cannot flow directly from the cooling medium inlet to the cooling medium outlet. The cooling medium only flows into that subchamber of the axial portion of the cooling chamber which is provided with cooling medium supply means, and is flung into the opposing axial portion, which is free of partitions, by the up and down movement of the piston. The partitions can be disposed either in the upper or in the lower axial portion of the cooling chamber. In either case, the cooling medium is distributed in the partition-free axial portion along the periphery of the piston. Only in the subsequent downward or upward stroke of the piston does the cooling medium again pass into that axial portion which is provided with partitions. That portion of the cooling medium which has flowed into the subchamber or subchambers provided with cooling medium withdrawal means is at least partially withdrawn. The remainder of the cooling medium in the other subchamber or subchambers participate, together with the freshly in-flowing cooling medium, once again in the process.

Thus, an intensive mixing of the cooling medium is achieved, and all of the partial flows of the cooling medium participate in the cooling process. In both subchambers, the cooling medium passes over the cylinder sleeve during the upward and downward movement of the piston, thereby effectively cooling the cylinder sleeve. As a result of the flow in the circumferential direction in the axial portion which is free of partitions, a further increase of the heat transfer is achieved as a result of the induced convection. The total effect of the inventive features leads to the desired and advantageous improvement of the cooling of the piston and the cylinder sleeve.

Pursuant to a further feature of the present invention, the axial portion of the cooling chamber which is free of partitions may be in the form of an annular groove which is disposed behind or radially inwardly of the sealing means of the piston, i.e. radially inwardly of the piston rings, which seal off the cooling chamber relative to the combustion chamber. In that case, the axial portion of the cooling chamber which is provided with partitions is provided at that end of the piston which is closest to the connecting rod. As a result of such an inventive embodiment of the piston, the thermally highly stressed portions of the piston in the vicinity of the sealing means thereof are effectively cooled. This particular advantage is possible only with an embodiment of this type, because only then can the cooling medium reach the region of the sealing means and can, when viewed in the axial direction of the piston, even reach regions of the piston which are disposed above the sealing means.

Pursuant to one preferred embodiment of the present invention, the cooling chamber is divided into a plurality of subchambers. The greater the number of subchambers, the more uniform will be the cooling effect upon the cylinder sleeve. However, since the cost of construction greatly increases with the number of subchambers, an embodiment having four or six subchambers is particularly suitable. The supply and withdrawal of cooling medium is always separate from one another into respective subchambers. The total number of subchambers therefore corresponds to a multiple of the number two.

Pursuant to further embodiments of the present invention, the cooling medium supply and withdrawal means may be disposed in the lower dead center position of the piston, with radial bores being provided in the wall of the cylinder sleeve. However, at least the cooling medium withdrawal means can also be a bore or bores in that wall of the piston which is closest to the connecting rod, so that these bores, which thus extend in the axial direction of the piston, connect the subchamber with the crank case. If the piston is not in the lower dead center position, the piston shell closes off the cooling medium supply means. As a result, the cooling medium remains for a definite period of time in the cooling chamber of the piston, so that its cooling effect can be intensively utilized. This is particularly true when the volume of the annular groove corresponds to the volume of those subchambers which are provided with a cooling medium supply means, because it is precisely then that all of the cooling medium can cool the upper portion of the piston. It is furthermore also possible to conduct the cooling medium from the annular groove into further cooling medium channels or chambers within the piston, where it can undertake still further cooling tasks.

Pursuant to a particularly advantageous embodiment of the piston, the volumes of the subchambers are approximately the same size. However, it can also be advantageous, for example in order to locally achieve particularly high cooling effects at the cylinder sleeve, to provide subchambers having varying volumes. A similar result can be achieved if the cooling medium supply and withdrawal means have nonuniform dimensions. In contrast thereto, in the preferred embodiment of the present invention, the flow-through cross-sectional areas of the cooling medium supply and withdrawal means are approximately the same, with the cooling medium withdrawal means advantageously having a slightly greater capacity in order to assure a reliable withdrawal of the cooling medium from the cooling chamber.

The motor oil of the internal combustion engine can be provided as the cooling medium. Pursuant to this inventive proposal, a separate cooling circulation system becomes unnecessary, and the piston does not have to be sealed off relative to the crank case. In so doing it is also possible, via a cooling circulation system, to have the motor oil cool the entire internal combustion engine, especially the outside of the cylinder head and the cylinder sleeve. With such an embodiment, advantageously only a single cooler, namely an oil cooler, is required. If the internal cylinder cooling suffices to cool the cylinder, an external cylinder sleeve cooling can be dispensed with entirely. By appropriately sealing off the cooling chamber, for example relative to the crank case, the overall cooling system can be used for any type of cooling medium.

DESCRIPTION OF PREFERRED EMBODIMENTS

Referring now to the drawings in detail, FIG. 1 illustrates one inventive embodiment of a piston 1 which is axially guided in a cylinder sleeve 2. The piston 1 is provided with a piston shell 3, a combustion chamber recess 4, and a cooling space or chamber 5. The cooling chamber 5 extends in the circumferential direction of the piston 1 once completely around the entire piston, and is essentially an annular or tube-like groove in the circumferential surface 14 of the piston 1; the cooling chamber 5 is open in the direction toward the cylinder sleeve 2 over the entire circumference of the piston. The cooling chamber 5 furthermore comprises two axial portions, with that one which is closest to the combustion chamber being in the form of an annular groove 7 which is formed by the inner piston body and an outer annular wall 17, which forms a boundary in the direction toward the cylinder sleeve 2 and supports the piston rings. In this axial portion, the cooling chamber 5 extends to behind the piston rings. The other axial portion is open in the direction toward the cylinder sleeve 2 over nearly its entire axial height, and is provided with four partitions 8. In the radial direction, these partitions 8 extend from the inner wall of the cooling chamber 5 to the circumferential surface 14 of the piston, and in the axial direction these partitions 8 extend from that end of the cooling chamber 5 which is closest to the connecting rod to the axial beginning of the annular groove 7. In this way, that axial portion which is closest to the connecting rod is divided into four nearly equal subchambers 9. The partitions 8 are a part of the piston 1. However, the partitions 8 could also be separate components, or the two axial portions of the cooling chamber 5 could be formed by a plurality of assembled parts of the piston.

Disposed in the vicinity of the lower dead center position of the piston 1, in the cylinder sleeve 2, are radial bores 10 which are located approximately in the center of the axial height of the lower axial portion of the cooling chamber 5. When viewed in the circumferential direction of the piston, for a given one of the subchambers 9 two radial bores 10 are provided in such a way that an approximately equal angular segment of the subchamber is allocated to each bore 10. Adjacent to a subchamber 9 into which the radial bores 10 open is a subchamber 9 which is provided with axial bores 11 in the wall 12 which is closest to the connecting rod. These axial bores 11 are symmetrically distributed in the subchamber 9.

The radial bores 10 in the wall of the cylinder sleeve 2 serve for the supply of cooling medium, while the axial bores 11 serve for the withdrawal of the cooling medium into the crank case. For a reliable withdrawal of the cooling medium, the diameter of the axial bores 11 is slightly greater than the diameter of the radial bores 10 which supply the cooling medium. A subchamber 9 to which cooling medium is supplied is always adjacent to a subchamber 9 from which cooling medium is withdrawn.

The size of the subchambers 9 is such that those subchambers to which cooling medium is supplied have a total volume which corresponds approximately to the volume of the annular groove 7. Furthermore, all of the subchambers 9 are of the same size. However, in order to achieve a desired, varied, local cooling of the wall of the cylinder sleeve, it may be expedient to make the subchambers different sizes.

Figure 3:
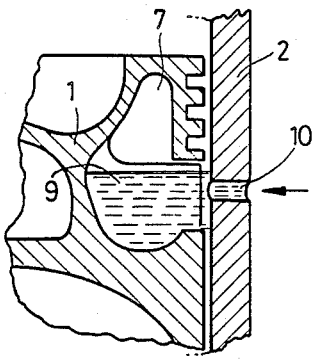
FIG. 3 is a partial axial section through a piston in the lower dead center position as cooling medium is being supplied.
Figure 4:
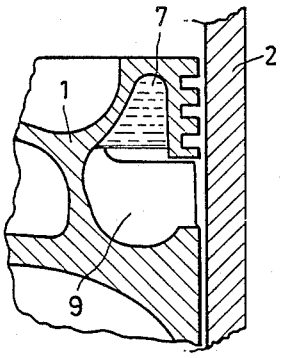
FIG. 4 is a partial axial section of the piston of FIG. 3 in the upper dead center position.
Figure 5:
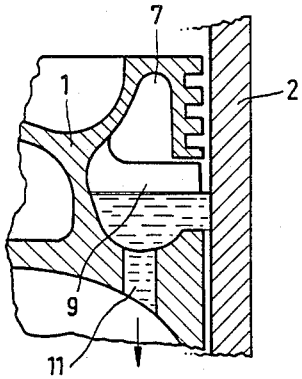
FIG. 5 is a partial axial section through a piston in the lower dead center position showing a subchamber from which cooling medium is being withdrawn.

FIGS. 3 to 5 illustrate the manner of operation of an inventive cooling arrangement for the cylinder sleeve 2 and the piston 1 of an internal combustion engine. When the piston 1 is in the lower dead center position, the cooling medium supply bores 10 which open into each second subchamber 9 are opened. The cooling medium can flow into the respective subchamber 9, and fills the latter up to the upper edge of the partitions 8. If the piston is now moved to the upper dead center position, the cooling medium in the cooling chamber 5 wets the periphery of the cylinder sleeve 2, thereby cooling the latter. After a certain height of the path of travel of the piston, as determined by the position of the cooling medium supply bores relative to the lower dead center position of the piston, has been passed, the piston shell closes off the cooling medium supply bores. As the piston decelerates as it nears the upper dead center position, all of the cooling medium is flung into the annular groove 7 of the cooling chamber 5 across from the subchambers 9. As a result of the axial acceleration, the cooling medium spreads out uniformly in the circumferential direction in the annular groove 7. Cooling of the piston 1 is intensified as a result of this flow movement of the cooling medium within the annular groove 7. Since the volume of all of the subchambers 9 which are provided with cooling medium supply bores corresponds to the overall volume of the annular groove 7, the cooling medium is completely accommodated by the annular groove 7 (FIG. 4). In the subsequent downward stroke of the piston, the cooling medium again returns to the subdivided axial portion of the cooling chamber 5 as a result of the oppositely directed acceleration which is induced. However, since the cooling medium was uniformly distributed over the entire periphery of the annular groove 7, half of the cooling medium enters those subchambers 9 from which cooling medium is withdrawn, and half of the cooling medium enters those subchambers 9 to which cooling medium is supplied. The cooling medium also lets the cylinder sleeve 2, thus cooling the latter, during the downward movement of the piston. As soon as the cooling medium is located in those subchambers 9 which are provided with the cooling medium withdrawal bores 11, the cooling medium is withdrawn through the latter. As the piston reaches the lower dead center position, the piston shell 3 uncovers the supply bores 10, and the cycle is restarted. It should be noted that more than two supply bores 10 or withdrawal bores 11 can be disposed in a given subchamber 9 of the piston 1.

In the inventive embodiment illustrated in FIGS. 1 to 5, cooling medium supply means are provided in the form of radial bores 10 in the cylinder sleeve 2, and cooling medium withdrawal means are provided in the form of axial bores 11 in the piston 1 However, it is also possible to provide the cooling medium withdrawal means in the cylinder sleeve 2 as well. Furthermore, in order to precisely control the time point at which cooling medium is supplied or withdrawn, the cooling medium supply means and also the withdrawal means can communicate with axially extending grooves in the wall of the cylinder sleeve 2 and also in the piston shell 3. This combination of axially extending grooves makes it possible, for example, to maintain the supply of cooling medium to the cooling chamber 5 from the lower dead center position all the way to the upper dead center position, or to a defined time point of the path of the piston.

FIGS. 6 and 7 illustrate the arrangement of an oil wiper for a cooling medium wiper. In this manner, a special oil or cooling medium wiping ring can be eliminated. In this inventive embodiment, there is provided on the piston 1, on the annular wall 17 which carries the piston rings, a flange-like element 13. This element 13 is disposed in the axial direction of the cylinder on the lower edge of the annular wall 17 closest to the connecting rod and on that side which faces the cylinder sleeve 2. To enhance the effect of the flange-like element 13, the latter is slotted numerous times in the axial direction, and is provided with a prestress. As a result of this prestress, prior to the piston 1 being installed in the cylinder sleeve 2, the flange-like element 13 projects radially outwardly from the circumferential surface 14 of the piston. Only in the installed state does the element 13 rest optimally against the cylinder sleeve 2, thus preventing cooling medium from entering the combustion chamber as a result of this sealing effect. To seal off the cooling chamber 5, the element 13 could similarly be provided with further sealing means on that end of the piston closest to the connecting rod, thus sealing off the cooling chamber 5 relative to the crank case so that a different cooling medium could be used.

FIGS. *7a–7c* illustrate various embodiments of the flange-like element 13. The element 13 preferably either projects as a completely separate element as shown in FIG. *7a*, or is produced by milling a groove 15 out of the annular wall 17 as shown in FIG. *7b*. However, the element 13 can also be an independent component as shown in FIG. *7c*. In the latter situation, the flange-like element 13 is connected to a main body 16 which is inserted into an annular, radially extending groove in the annular wall 17. The element 13, which produces the sealing effect, extends axially from the main body 16 in the direction toward that end of the piston 1 which is closest to the connecting rod. The entire separate component can be made of the material which is different than that of the piston 1. In this connection, ceramic and also a highly-alloyed metal material are of particular significance.

The present invention is, of course, in no way restricted to the specific disclosure of the specification and drawings, but also encompasses any modifications within the scope of the appended claims.

What I claim is:

1. An arrangement for cooling the pistons and cylinder sleeves of piston/cylinder units of an internal combustion engine; each piston/cylinder unit has at least one cooling chamber, which is delimited by the piston and cylinder sleeve of that unit, and also has suitable sealing means, such as piston rings, provided on that end of said piston closest to the combustion chamber; said cooling chamber extends in the circumferential direction of said piston, is provided with means to supply cooling medium thereto and with means to withdraw cooling medium therefrom, and is provided with at least two approximately axially extending guide elements;

the improvement wherein said guide elements are in the form of partitions, with the height of said partitions, as measured in the axial direction of said cylinder, being less than the similarly measured height of said cooling chamber, so that the latter is divided into two axial portions, namely a first axial portion in which said partitions extend, and a second axial portion which is free of said partitions; when viewed in the circumferential direction of said piston, said partitions divide said first axial portion of said cooling chamber into at least two subchambers which are separated from one another, yet communicate with one another via said second axial portion of said cooling chamber; a given subchamber is provided with said cooling medium supply means, and the adjacent subchamber is provided with said cooling medium withdrawal means.

2. An arrangement according to claim 1, in which said second axial portion of said cooling chamber, which is free of said partitions, is in the form of an annular groove and is disposed radially inwardly of said sealing means of said piston.

3. An arrangement according to claim 2, in which said first axial portion of said cooling chamber, in which said partitions extend, is disposed remote from that end of said piston closest to the combustion chamber.

4. An arrangement according to claim 2, in which the volume of said annular groove portion of said cooling chamber corresponds approximately to the total volume of those of said subchambers which are provided with said cooling medium supply means.

5. An arrangement according to claim 2, in which said cooling chamber is disposed in said piston and opens out toward said cylinder sleeve; and in which one of said axial portions of said cooling chamber is disposed in that part of said piston closest to said combustion chamber, and is provided on the radially outer edge at said opening of said cooling chamber with a thin-walled flange-like element.

6. An arrangement according to claim 5, in which said flange-like element extends over the entire circumference of said piston, and is coaxial to the axis of said cylinder.

7. An arrangement according to claim 5, in which said piston is provided with an annular wall which forms the radially outward portion of said annular groove of said cooling chamber; and in which said flange-like element is formed on said annular wall remote from said combustion chamber and adjacent to said cylinder sleeve.

8. An arrangement according to claim 7, in which said flange-like element is provided with a plurality of slots which extend in the axial direction of said cylinder.

9. An arrangement according to claim 7, in which said flange-like element extends outwardly away from said annular wall at an acute angle of approximately 0°–15° relative to the axis of said cylinder; and in which, when said piston is installed in said cylinder, said flange-like element rests against said cylinder sleeve with inherent tension.

10. An arrangement according to claim 5, in which said piston is provided with an annular wall which forms the radially outward portion of said annular groove of said cooling chamber; and in which said flange-like element is part of a separate component which is inserted in said annular wall.

11. An arrangement according to claim 10, in which said separate component is a ceramic member.

12. An arrangement according to claim 1, in which said first axial portion of said cooling chamber, in which said partitions extend, is divided into a number of said subchambers, with said number being an integral multiple of the number two.

13. An arrangement according to claim 1, in which said cooling medium withdrawal means is in the form of at least one bore disposed in said piston

14. An arrangement according to claim 1, in which at least one of said cylinder sleeve and said piston is provided with a pocket which communicates with said cooling medium supply means.

15. An arrangement according to claim 1, in which at least one of said cylinder sleeve and said piston is provided with groove means which communicate with said cooling medium supply means.

16. An arrangement according to claim 1, in which said cooling medium supply means is radially disposed in said cylinder sleeve; and in which at least one of said cooling medium supply means and said cooling medium withdrawal means is disposed in the lower dead center position of said piston.

17. An arrangement according to claim 16, in which no cooling medium supply and withdrawal means are disposed in the upper dead center position of said piston.

18. An arrangement according to claim 1, in which the volume of each of said subchambers is the same

19. An arrangement according to claim 1, in which said cooling medium is the motor oil of said internal combustion engine.

* * * * *